United States Patent [19]

Mauleon et al.

[11] Patent Number: 4,875,993

[45] Date of Patent: Oct. 24, 1989

[54] PROCESS AND APPARATUS FOR THE CATALYTIC CRACKING OF HYDROCARBON CHARGES

[75] Inventors: Jean-Louis Mauleon, Marly-le-Roi; Jean-Bernard Sigaud, Vaucresson; Bernard Chapotel, Paris, all of France; Leonard Seglin, New York, N.Y.

[73] Assignee: Compagnie de Raffinage et de Distribution Total France, Paris, France

[21] Appl. No.: 186,396

[22] Filed: Apr. 26, 1988

[51] Int. Cl.[4] ..... C10G 11/18

[52] U.S. Cl. ..... 208/113; 208/153; 208/155; 208/164

[58] Field of Search ..... 208/113, 164, 153, 155

[56] References Cited

U.S. PATENT DOCUMENTS

| | | | |
|---|---|---|---|
| 2,420,558 | 5/1947 | Munday | 208/113 |
| 2,889,269 | 6/1959 | Nicholson | 208/149 |
| 2,892,773 | 6/1959 | Hirsch et al. | 208/155 |
| 3,008,896 | 11/1961 | Laisson | 208/149 |
| 3,886,060 | 5/1975 | Owen | 208/74 |
| 4,057,397 | 11/1977 | Gross | 208/164 |
| 4,116,814 | 9/1978 | Zahner | 208/164 |
| 4,390,503 | 6/1983 | Walters et al. | 208/161 |
| 4,414,098 | 11/1983 | Zandona et al. | 208/120 |
| 4,478,708 | 10/1984 | Farnsworth | 208/161 |
| 4,606,810 | 8/1986 | Krambeck et al. | 208/155 |
| 4,787,967 | 11/1988 | Herbst et al. | 208/113 |

FOREIGN PATENT DOCUMENTS

| | | | |
|---|---|---|---|
| 0137998 | 8/1984 | European Pat. Off. | 208/113 |
| 0234924 | 2/1986 | European Pat. Off. | 208/113 |

*Primary Examiner*—Anthony McFarlane

*Attorney, Agent, or Firm*—A. Thomas S. Safford

[57] ABSTRACT

The invention relates to a process and apparatus for catalytic cracking in a fluid phase of a hydrocarbon charge. The process comprises contacting, in ascending or descending flow, the charge and grains of a cracking catalyst in a tubular reactor, ballistically separating the spent catalyst and the cracked charge downstream of the end of said reactor, mixing spent catalyst with grains of at least partially regenerated catalyst having a temperature exceeding that of the grains of spent catalyst, stripping spent catalyst in a dense fluidized phase by means of a fluid injected counter-current into this catalyst regenerating the catalyst under conditions to effect combustion of coke deposited thereon, and recycling regenerated catalyst to feed the reactor.

9 Claims, 2 Drawing Sheets

PROCESS AND APPARATUS FOR THE CATALYTIC CRACKING OF HYDROCARBON CHARGES

The present invention relates to the catalytic cracking of hydrocarbon charges. It relates, more particularly, to improvements in respect of the separation of the products of the cracking reaction from spent catalyst.

BACKGROUND OF THE INVENTION

In processes referred to as catalytic cracking (ie English, Fluid Catalytic Cracking, or FCC) processes, it is known that a hydrocarbon charge is vaporized by bringing it into contact at a high temperature with an appropriate cracking catalyst which is maintained in suspension. Once a desired range of molecular weights has been achieved by cracking, with a corresponding lowering of the boiling point, the catalyst is rapidly separated from the lighter products obtained; the catalyst is subsequently regenerated by the combustion of coke deposited on its surface during the reaction, and then returned to the reaction zone together with the hydrocarbon charge.

In practice, the catalyst which has been regenerated (at a temperature which usually exceeds 600° C.) and the charge to be treated are brought into contact continuously in a vertical or inclined tubular reactor. The latter, when working in ascending manner, is frequently referred to by specialists in the field by the term "riser", and is designated by the term "dropper" when it works in descending manner. The charge, usually preheated to a temperature of 80°to 400° C., is injected at a pressure of between $0,7\times10$ and $3,5\times10$ pa, and vaporizes and then cracks when coming into contact with the active sites of the catalyst, while effecting pneumatic conveyance of the grains of the catalyst, the desired average size of which is approximately 70 microns. After a contact time in the order of 0,1 to 10 seconds, the hydrocarbon vapours, at a temperature in the order of 475°to 575° C., are separated from the spent catalyst by means of a ballistic separator at the outlet of the tubular reactor. This separator is provided in a zone above which the hydrocarbon vapours rise, which vapours, after recovery of the catalyst fines therefrom by a cyclone, is dispatched to a fractionation apparatus. The grains of catalyst, under gravity, fall below said zone into a dense fluid-bed medium where, in order to be separated completely from the hydrocarbons still present in their pores, they are stripped by means of vapour. The stripped grains of catalyst are then removed to a regenerator where their catalytic activity is restored by combustion of coke deposited thereon during the cracking reaction.

During regeneration, combustion heat is distributed between the catalyst (approximately 70%) and fumes produced by the regeneration. The regenerated catalyst is recycled to the reaction zone, where the portion of the heat of combustion of the coke taken up by the catalyst in the regenerator is used to vaporize the charge, to provide reaction heat (the cracking reaction being endothermic) and to compensate for various thermal losses, thus ensuring the thermal equilibrium of the unit. The duration of an average cycle, for the catalyst, is approximately 15 minutes.

The FCC process is therefore employed such that the cracking unit is in thermal equilibrium, all the necessary heat being supplied by the combustion of the coke deposited on the grains of catalyst in the course of the cracking reaction. The relationship "preheating temperature of the charge/circulation of the regenerated catalyst" is therefore adjusted so as to obtain the desired reaction temperature in the entire reaction zone and, in particular, at the exit of the reactor.

The quantity of coke deposited on the catalyst is, therefore, a fundamental variable of the reaction, since it contributes to the supply of the heat required for the cracking of the hydrocarbons. The quantity of coke deposited on the grains of catalyst during the reaction is, however, frequently greater than that required to ensure the thermal equilibrium of the unit:

this is the case in particular when the hydrocarbon charges to be cracked are rich in heavy products such as asphaltenes or compounds having a high metal content;

this also frequently occurs because of a poor separation of the products of the cracking reaction or an inadequate stripping of hydrocarbons from the grains of catalyst coming from the cracking reaction.

This excess coke sent into the regenerator is due, at least partly, to the fact that not inconsiderable quantities of hydrocarbon residues (the hydrogen content of which may be between 5 and 10% by mass) cannot be separated from the grains of catalyst by the usual separation means. This results in too high a regeneration temperature, which is detrimental to the proper functioning of the reactor, and which is to the detriment of the quantity of product quality which can be obtained and which is recovered in the fractionation zone.

The most recent developments in the field of catalytic cracking have heretofore aspired to meet the aforementioned difficulties:

either by withdrawing excess heat from the regenerator so as to limit the increase in the regeneration temperature, or by carrying out the regeneration in two stages which permits reaching far higher final regeneration temperatures for the catalyst.

The present invention aims to improve substantially the separation of the effluents of the cracking reaction and the stripping of the catalyst, so as to limit losses in hydrocarbon residues and to regenerate spent catalyst containing essentially only such coke as is necessary to ensure thermal equilibrium of the unit.

In fact, in the chambers for the separation of the effluents and the stripping of the spent catalyst used in the past, two distinct zones can be distinguished. In a first zone, or disengagement zone, a ballistic device of the kind known per se (see, for example, U.S. Pat. Nos. 2 420 558, 4 057 397, 4 478 708, or French Pat. Nos. 2 574 422 and 2 576 906) permits the downward movement of the grains of catalyst, while the hydrocarbon vapours rise upwards and are, after separation of the fines by means of a system of cyclones, dispatched to the fractionation zone. This operation which is most frequently carried out in a dilute fluidized phase, ensures a separation which is both rapid and effective between a substantial portion of hydrocarbon vapours and the grains of catalyst. In the second zone, taking place in a dense fluidized phase, below the ballistic-separation zone just mentioned, is a stripping operation during which the transport and the recovery of the gaseous hydrocarbons carried in the catalyst suspension are ensured by a counter-current stripping by means of a gaseous fluid such as water vapour. It is essential that the bringing into contact of catalyst and stripping fluid is effective and that any remixing is minimized. Generally, the stripping itself takes place in a dense phase, in a chamber usually characterized by an elevated ratio of height to diameter. This chamber is frequently provided with internal baffle-plates, in order to promote the contact of the catalyst in suspension with the stripping fluid.

In this second zone, the desorption of the heaviest hydrocarbons trapped on the catalyst is promoted by maintaining a partial pressure as low as possible of the hydrocarbons in vapour phase, relative to their so called bubble or blistering pressure, ie by maintaining an elevated temperature and low pressure. The use of very polar stripping fluids, such as water vapour, which are much more readily absorbed than the hydrocarbons, tends to promote the desorption of the hydrocarbons.

The stripping reaction, either by desorption or by transport of the hydrocarbons carried along, is relatively rapid. It is therefore useless to attempt to seek a greater stripping effectiveness by prolonging the time of catalyst contact with the stripping fluid because, during the stripping operation, the conditions are equally favourable to reactions for the coking of heavy hydrocarbons with the production of hydrogen and, more particularly, methane; the net result therefore is a reduction of the hydrogen in the residual coke remaining on the spent catalyst, to the benefit of the production of light gases.

BRIEF SUMMARY OF THE INVENTION

Within the framework of their activities in the field of catalytic cracking, the applicants have established that the recovery of the hydrocarbon effluents from the cracking reaction can be improved considerably by using, between the two zones described above, a mixture of the grains of spent catalyst from the ballistic separation zone with grains of regenerated or partially regenerated catalyst having a temperature exceeding that of the grains of spent catalyst.

It has already been proposed (see U.S. Pat. No. 3,886,060) to recycle the hot regenerated catalyst into the interior of the zone for the stripping of the spent catalyst, but injection there of the regenerated catalyst does not have the aim of improving stripping and does not permit a substantial raising of the temperature of the dense fluidized bed in the vicinity of the interface between the latter and the dilute fluidized phase above.

Likewise, European Pat. No. 137 998 teaches the utilization of a second stripping chamber in which the spent catalyst is mixed with the hot regenerated catalyst in order to vaporize the heavy hydrocarbons which are possibly present on the spent catalyst. The recovery of the effluents is thereby improved, but it is necessary to use two stripping chambers.

The present invention aspires to reduce this disadvantage. According to the invention, in the catalytic cracking in a fluid phase of a hydrocarbon charge, there is provided a process which comprises a stage for bringing into contact, in ascending or descending flow, said charge and the grains of a cracking catalyst in a tubular reactor, a stage for ballistic separation of spent catalyst and cracked charge downstream of said reactor, a stage for stripping the spent catalyst in a dense fluidized phase by means of a fluid injected counter-current into this catalyst, a stage for regenerating said catalyst under conditions which effect combustion of the coke deposited thereon, and a stage for recycling regenerated catalyst to feed said reactor, the process including a stage whereby between said ballistic-separation stage and said stripping stage, said spent catalyst is homogeneously mixed with grains of at least partially regenerated catalyst which have a temperature exceeding that of the grains of spent catalyst, and which are distributed substantially homogeneously above the dense fluidized phase.

The grains of hot catalyst from the regeneration zone are advantageously mixed in a quantity and at a temperature such that the local temperature of the mixture resulting from this dispersion is increased by between 10°and 150° C. and preferably between 20°and 70° C.

This catalyst mixture or recycle, hot and at least partially regenerated, has itself preferably been previously stripped, in order to eliminate the presence of inert compounds arising from the entrainment of regeneration gas, so as to avoid wasteful overloading of the cracked gas compressor.

The quantity of catalyst recycled is therefore a function of the temperature difference between the grains of catalyst from the regeneration zone and those of the spent catalyst. Depending on the type of regeneration used in the cracking unit, the recycled catalyst can, advantageously, be either completely regenerated, to the same degree as the catalyst feeding the reaction stage, or only partially regenerated and, in that event, the catalyst recycled according to the invention may be taken from various points of the regeneration stage and, in particular, in the first regeneration chamber if the unit has a number of successive chambers for the regeneration of the spent catalyst.

According to the configuration of the unit, the recycle of the grains of hot and at least partially regenerated catalyst takes place:

either by gravity, when the zone for the regeneration of the catalyst is in a position above that of said zone for the introduction of the grains and, in particular, when the unit operates in descending fashion (dropper), or by pneumatic conveyance by means of a fluid, preferably water vapour or a light hydrocarbon, on its own or mixed.

The recycle of the grains of catalyst is carried out preferably in the immediate vicinity of the surface of the dense fluid bed of the stripping zone.

In the majority of cases, the dispersion of the hot catalyst from the regenerator is carried out in homogeneous manner, along the entire horizontal cross section of the chamber, in the dilute fluidized phase situated immediately above the upper surface of the dense fluidized bed in which the stripping of the grains of spent catalyst takes place.

The invention also relates to an apparatus for the catalytic cracking of a hydrocarbon charge comprising a column for cracking in ascending or descending flow, means to feed grains of regenerated catalyst to the upstream end of said column, means for the introduction under pressure into said column of a hydrocarbon charge, means for the ballistic separation of products of the cracked charge and the grains of spent catalyst, at least one means for stripping the spent catalyst in a dense fluidized phase, by means of at least one fluid, at least one unit for the regeneration of said catalyst by combustion of coke deposited thereon, and means for the recycling of the regenerated catalyst to feed said column, the apparatus comprising, between said means for ballistic separation and said stripping means, at least one means for substantially homogeneous distribution, above said dense fluidized phase, of grains of catalyst which are at least partially regenerated, and which have a temperature exceeding that of the grains of spent catalyst, which are thereby mixed homogeneously with said spent catalyst.

The means for the introduction and the dispersion of the hot regenerated catalyst is arranged such that the mixing with the spent catalyst takes place in the immediate vicinity of the surface of the dense fluidized phase of the stripping zone.

When the stripping chamber is of the kind provided with internal baffle-plates and which has an elevated ratio of height to diameter, the introduction of the hot and at least partially regenerated catalyst may be carried out, in a simple fashion and in a manner known per se, by means of the dumping of said catalyst immediately above the surface of the dense bed. This type of stripping chamber indeed promotes an immediate homogeneous mixing of the grains of catalyst at the upper part of the bed.

In the majority of cases, however, the grains of hot and at least partially regenerated catalyst are dispersed homogeneously along the entire horizontal section of the dilute fluidized phase situated immediately above the surface of the dense fluidized bed of the stripping zone, so that the hydrocarbons vaporized during this dispersion are immediately displaced by the ascending water vapour. It is self-evident that such a vapourization of the hydrocarbons remaining at the surface of the grains of catalyst is all the better because the ballistic device situated above the exit from the reaction zone will, itself, ensure a good homogeneous dispersion of the grains of catalyst along the entire cross-section of the chamber.

The invention has numerous advantages relative to known systems for the stripping of the catalyst generally used in processes for the catalytic cracking of hydrocarbon charges, as follows:

even when, in the usual stripping devices, the temperature of the suspension of the spent catalyst is generally not adequate appreciably to displace the equilibrium of the desorption of the hydrocarbons remaining on the catalyst, especially if the cracking conditions are not very harsh, the increase in temperature which results from the recycle of hot and at least partially regenerated catalyst results in a better desorption of the heavy and/or viscous hydrocarbons, as good in the dense fluidized phase as in the dilute fluidized phase thereabove; this brings about an improved recovery of the products of cracking and, consequently, a lower temperature for the regeneration of the catalyst;

the recycling of the catalyst avoids, at the time of combustion in the regenerator, the formation of hot spots which adversely affect the activity of the catalyst and which are linked to the combustion, particularly exothermic combustion, of hydrocarbon compounds remaining on the surface of the grains of catalyst;

the mixing of the spent catalyst and at least partially regenerated catalyst permits an increase in capacity for thermal absorption of the heat of combustion of the coke in the regenerator, which results in an improved homogeneity of the temperature and of the combustion in the regenerator;

the mixing of the spent catalyst and at least partially regenerated catalyst moreover permits a substantial increase of the temperature of the grains of catalyst introduced into the regeneration unit and coming from the stripping zone; as a result, the kinetics of combustion are more rapid than in units of the conventional kind, and catalyst inventory can be reduced substantially;

finally, the applicants have noted that the rise in temperature of the stripping zone, due to the introduction of at least partially regenerated catalyst, unexpectedly results in an appreciable reduction in the content of oxides of nitrogen and of sulphur in the regeneration fumes, this reduction originating from a greater desorption of the heterogeneous polar compounds containing sulphur and nitrogen, as well as a reductionhydrolysis with production of hydrogen sulphide from sulphates formed during the regeneration.

BRIEF DESCRIPTION OF THE DRAWINGS

The attached drawings schematically illustrate various forms of application of the invention. In these drawings.

DETAILED DESCRIPTION OF THE PREFERRED EMBODIMENTS

Figure 1:
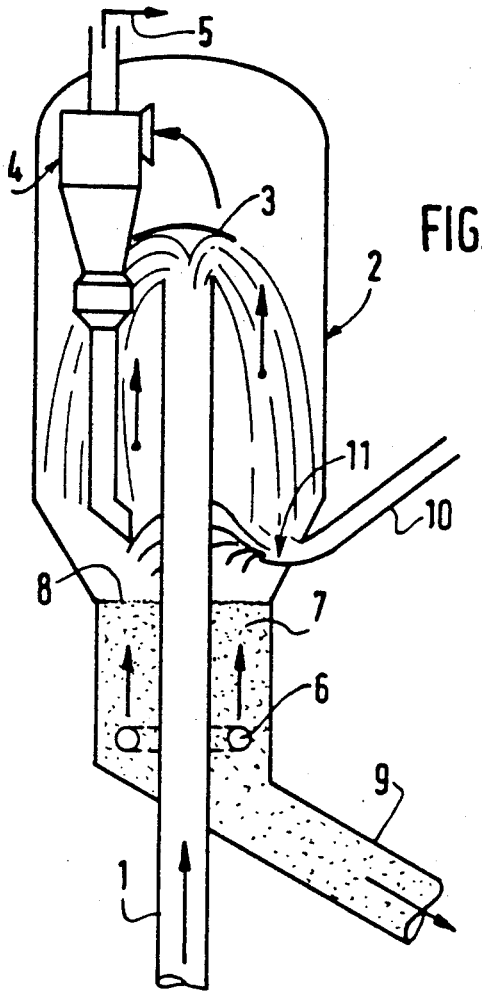
FIG. 1 represents a device for the separation and stripping of spent catalyst disposed in the upper part of a rising-flow cracking column, with injection by gravity of hot regenerated catalyst.

FIG. 1 shows the upper part of a column 1 for cracking in ascending flow, opening into a chamber 2 which is concentric with the former, facing a ballistic separator 3 for promoting separation of the homogeneous dispersion across the entire cross-section of the chamber 2, and the falling under gravity of the grains of spent catalyst. The products from cracking pass through a cyclone 4, where they are separated from the last particles of catalyst, and they are then evacuated via a line 5 to a fractionation zone. The particles of spent catalyst are again collected under gravity at the base of the chamber 2, where a stripping fluid, such as water vapour, is introduced in counter-current flow by the diffuser 6, the particles forming a dense fluidized bed of catalyst. The stripped catalyst is then evacuated via the duct 9 from the base of the chamber 2, to a regeneration apparatus which is not illustrated.

According to the invention, a portion of the catalyst from the regeneration zone, the temperature of which exceeds that of the grains of spent catalyst, is introduced via line 10 into the dilute fluidized bed and is dispersed in substantially homogeneous manner.

To this end, in the case of the embodiment represented in FIG. 1, the inclined duct 10 is extended at its downstream extremity by a section 11 which is curved upwards, which ensures the homogeneous distribution by gravity of the catalyst along the horizontal cross-section of the chamber 2, immediately above the surface 8 of the dense fluidized bed 7.

The temperature, at the exit from the column 1 and in the upper part of the chamber 2, is, for example, between 480°and 550° C., so that, when injecting an adequate quantity of regenerated catalyst at a temperature of between 650°and 850° C., it will be possible to raise the temperature of the catalyst in dense fluidized phase to a temperature between 550°and 650° C.

By way of variation and in order to ensure the homogeneity of the dispersion of the recycled catalyst, the curved section 11 extending the duct 10 may comprise two branches separated by a gap directed towards the column 1, so as to project two jets of catalyst on opposite sides of this column.

Figure 2:
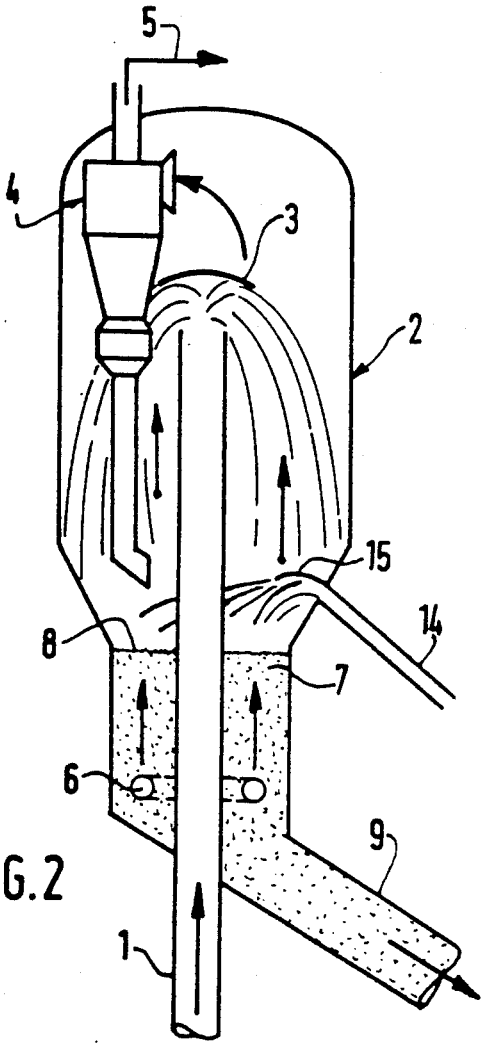
FIGS. 2 and 3 are analogous views in the case of the injection into the stripping chamber of regenerated catalyst in suspension in a fluid.
Figure 3:
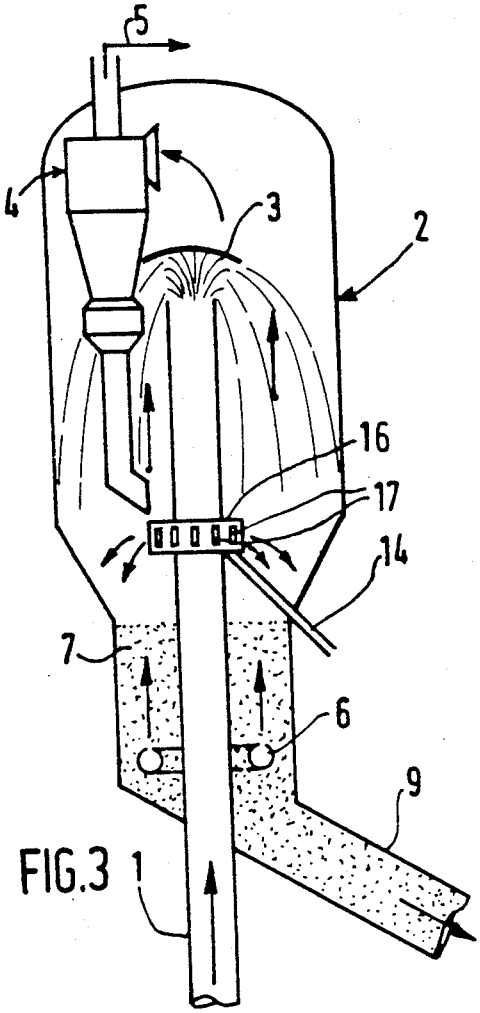

In FIGS. 2 and 3, which represent variations of the application of the invention in the case of a rising cracking column, or "riser", the components already described with reference to FIG. 1, are designated by the same reference numerals.

In the form of embodiment of FIG. 2, the recycled catalyst is no longer distributed by gravity in the chamber 2, but is carried by a carrier fluid, such as water vapour, a light hydrocarbon or a mixture of the two. In this embodiment, the catalyst supply duct 14 is an ascending duct opening laterally into the chamber 2 and extended at its upper part by a curved section 15 which forms a deflector for the particles of catalyst, so as to permit a homogeneous dispersion in the dilute fluidized phase situated immediately above the surface 8 of the stripping bed 7.

In the variation according to FIG. 3, the recycled catalyst is again directed into the chamber 2 by a carrier fluid moving along an ascending duct 14, but this duct opens at the centre of the chamber into an annular distributor 16 encircling the column 1, the distributor distributing the catalyst via lateral apertures 17.

Figure 4:
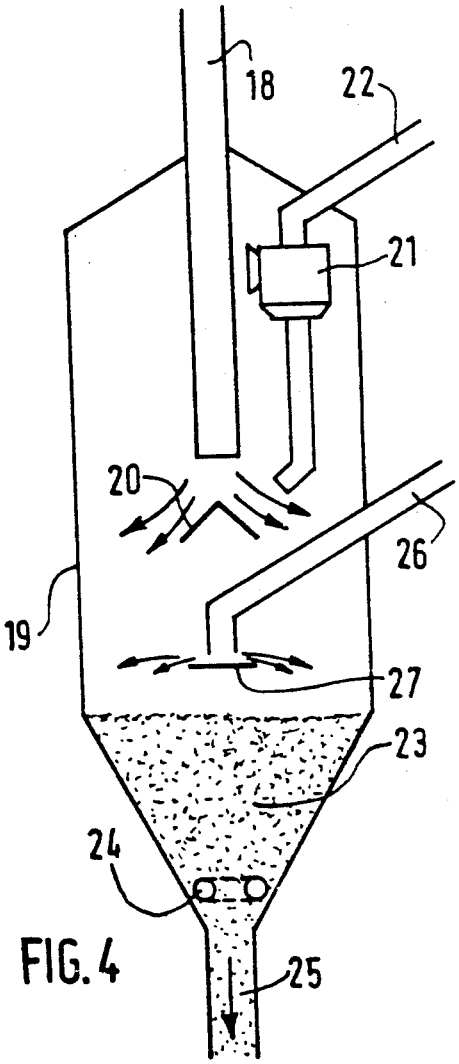
FIG. 4 represents a device for the separation and stripping of spent catalyst, disposed in the lower part of a descending-flow cracking column.

The invention applies equally to apparatus having a descending cracking column or "dropper", as is represented in FIG. 4.

In this case, the column 18 opens into the chamber 19, immediately above a deflector 20 which distributes the spent catalyst in the chamber while ensuring the release of the hydrocarbons: as previously set forth, the hydrocarbon vapours pass through a cyclone 21 and are evacuated via the line 22, while the grains of catalyst are collected at the bottom of the chamber. They are maintained there in a dense fluidized bed 23 and are stripped by means of water vapour injected via 24 before being evacuated via the duct 25 to the regenerator. The catalyst recycle is introduced into the chamber 19 via an inclined duct 26 which discharges immediately above a distributor 27, in this case disposed in the centre of the chamber 19, below the deflector 20.

In all its forms of application, the invention therefore makes use of simple means, permitting the substantial improvement of the separation of the products of cracking and the spent catalyst, as well as the quality of the stripping.

This application corresponds to French patent application No. 87-01690, filed Feb. 11, 1987, the French text of which is incorporated herein by reference.

What is claimed:

1. A process for the catalytic cracking in a fluidized bed of a hydrocarbon charge comprising:

contacting the charge and grains of a cracking catalyst, in ascending or descending flow in a tubular reactor, to crack the charge and give a spent catalyst with coke deposited thereon;

separating, by ballistic means, the spent catalyst and the cracked charge in a separation zone containing a dilute fluidized phase located above a dense fluidized bed;

mixing in said separation zone spent catalyst with grains of an at least partially regenerated catalyst which has a temperature exceeding that of the spent catalyst, and which grains are distributed in said separation zone substantially homogeneously in the dilute fluidized phase above the dense fluidized bed and between the ballistic means and an upper surface of the dense fluidized bed;

stripping the spent catalyst in the dense fluidized bed by means of a fluid injected counter-current into the spent catalyst to give a stripped catalyst;

regenerating the stripped catalyst in a regeneration zone under conditions effective to result in combustion of the coke deposited thereon to give a regenerated catalyst; and recycling the regenerated catalyst to feed the reactor.

2. The process according to claim 1, wherein the spent catalyst is mixed with the grains of the partially regenerated catalyst in a sufficient quantity and at a temperature effective to result in a rise in reaction temperature of between 10°and 150° C.

3. The process according to claim 2, wherein the rise in temperature is between 20°and 70° C.

4. The process according to claim 1, wherein the catalyst is introduced by homogeneous dispersion across the entire horizontal cross-section of the dilute fluidized phase above the surface of the dense fluidized bed.

5. The process according to claim 1, wherein the partially regenerated catalyst is produced in the regeneration zone.

6. The process according to claim 5, wherein the regeneration zone comprises a plurality of regeneration chambers wherein the partially regenerated catalyst is taken from the first regeneration chamber.

7. The process according to claim 5, wherein combustion gases are separated from the partially regenerated catalyst.

8. The process according to claim 7, wherein the separation of the combustion gases is carried out by fluid stripping.

9. The process according to claim 8, wherein the stripping fluid is selected from the group consisting of water vapor, inert gases or mixtures of water and one or more inert gases.

* * * * *